United States Patent [19]

Knackstedt et al.

[11] 4,339,411

[45] Jul. 13, 1982

[54] SHIELDING CONTAINER FOR THE TRANSPORTATION AND/OR FOR STORAGE OF SPENT FUEL ELEMENTS

[75] Inventors: Hans-Günther Knackstedt, Langenselbold; Reiner Laug, Hanau; Erhard Müller, Gründau, all of Fed. Rep. of Germany

[73] Assignee: Degussa Transnuklear GmbH, Hanau, Fed. Rep. of Germany

[21] Appl. No.: 139,677

[22] Filed: Apr. 14, 1980

[30] Foreign Application Priority Data

Apr. 14, 1979 [DE] Fed. Rep. of Germany ... 7911030[U]

[51] Int. Cl.[3] ..... G21F 5/00

[52] U.S. Cl. ..... 376/272; 250/506

[58] Field of Search ..... 176/30; 250/506, 507

[56] References Cited

U.S. PATENT DOCUMENTS

| | | | |
|---|---|---|---|
| 3,727,060 | 4/1973 | Blum | 250/506 |
| 3,780,306 | 12/1973 | Anderson | 250/507 |
| 4,147,938 | 4/1979 | Heckman | 250/506 |
| 4,234,798 | 11/1980 | Baatz | 250/506 |

*Primary Examiner*—Donald P. Walsh

*Attorney, Agent, or Firm*—Cushman, Darby & Cushman

[57] ABSTRACT

Shielding containers are needed for the transportation and or storage of spent fuel elements from nuclear reactors, which containers permit ready adjustment to the transportation conditions in regard to shielding and are easy to clean and repair. This is attained by using a cooling finned jacekt as neutron shield which is constructed of several removable segments, which in each case consist of two concentric, metallic cylindrical wall sections joined together through heat conducting bars.

24 Claims, 4 Drawing Figures

SHIELDING CONTAINER FOR THE TRANSPORTATION AND/OR FOR STORAGE OF SPENT FUEL ELEMENTS

BACKGROUND OF THE INVENTION

The invention is directed to a shielding container for the transportation and/or storage of spent fuel elements from nuclear reactors, said container having a cooling fin jacket made of several removable members fitted to the container.

Containers which are employed for the transportation and/or storage of spent fuel elements must safely seal in the radioactivity of the inserted material and demonstrate in strength tests that this is also guaranteed in extreme accident situations. However, they must simultaneously shield off the gamma and neutron rays set free in the radioactive decay reactions and lead off the heat of decay to the outside.

Known shielding containers mostly consist of a metallic base container having the required mechanical strength and the wall strength necessary for the shielding off of the gamma rays; customarily they are made of steel or a combination of lead and steel, and of an outer sheet of a neutron shielding material, mostly of small pellets of polyethylene cast in synthetic resin. There are normally welded or soldered to the metallic base article, heat conducting bars or fins penetrating the resin layer. They are necessary for enlarging the metallic surface in containers which are designed for a high neat conductivity and for carrying off the heat through the generally poor heat conducting neutron shielding layer.

It is a disadvantage of this construction that collisions of the container, which can even occur in routine operation, can lead to damage of the heat conductivity fins and resin layer and accordingly make necessary an expensive repair of the fin zone.

Furthermore a purification or, in case of contamination, a decontamination of the outer surface of the container formed by the fins or bars is difficult. Therefore this is protected by applying a protective shell in handling operations, in which there exists the danger of the contamination of the surface, thus for example, in the loading and emptying.

A further disadvantage of this known shielding container is that the number of heat conducting fins and the thickness of the neutron shielding must be designed for the maximum load predicted ynqvransportation situations. However, in a large part of the transportation and in using them as stored containers they contain spent fuel elements which are already so farly decayed in the fuel element storage basins of the nuclear power plant that in these cases both the neutron shielding as well as the fin surfaces of the container are over dimensioned.

Therefore it has already been proposed to provide the shielding container with a so-called cooling fin jacket constructed of several removable segments fitted to the container wall which are easily exchanged for repair and can be easily adapted to the particular transportation employed.

These cooling fin jackets, however, in many cases have the disadvantage that they are not intrinsically stable structures since they consist of a large number of individual segments. These can only be disassembled successively after removing the retaining members or again be reassembled with difficulty. This frequently results in time consuming and difficult handling. Furthermore in constructions which consist of many removable individual segments gaps between these are present which frequently either must be separately sealed with a permanently elastic, temperature resistant composition and continuously attended to or after a contamination if necessary can only be decontaminated through disassembling the entire individual elements.

As a result the filled container is without cooling elements for the duration of the decontamination and it can be heated up to an inadmissible extent.

Therefore it was the problem of the present invention to provide a shielding container for the transportation and/or for the storage of spent fuel elements from nuclear reactors which has a cooling fin jacket of several removable individual parts fitted to the container wall, which, however, avoids the above disadvantages, particularly is intrinsically stable, easily disassembled and reassembled and is free as possible from maintenance.

SUMMARY OF THE INVENTION

This problem was solved according to the invention by providing that the individual parts of the cooling fin jacket in each case consist of two concentrical metallic, cylindrical wall sections joined together by heat conducting bars. Advantageously the cooling fin jacket at most has four such individual parts.

The advantages of this embodiment is that the surface of the cooling fin jacket is free of gaps up to the parting line of the individual parts. It is possible through this to again decontaminate by a simple agent and with slight expenditure of time the surface of the cooling fin jacket placed around the jacket which surface has perhaps been contaminated in the handling.

Through interchanging of these individual parts there is indeed possible, depending on the type of radiating transported-stored material an adjustment in the strength of the neutron shielding, in the required cooling capacity and in the shielding of gamma radiation.

The shielding container can comprise, consist essentially of or consist of the parts set forth.

DESCRIPTION OF THE PREFERRED EMBODIMENTS

Figure 1:
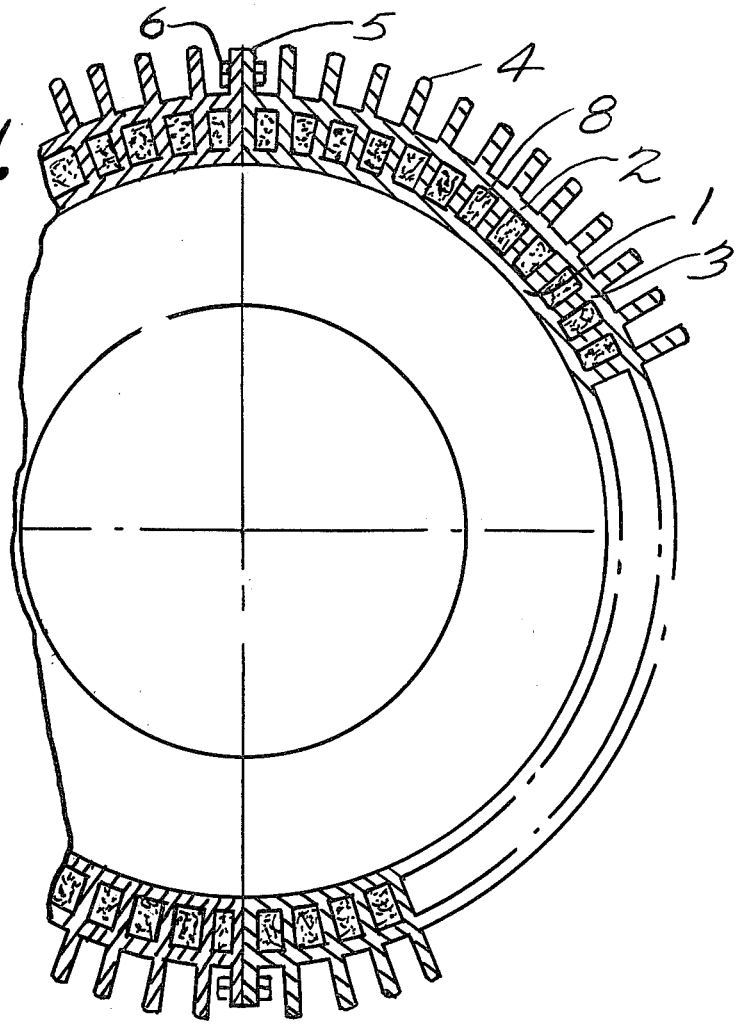
FIG. 1 is a schematic cross-section through a container having the novel cooling fin jacket of the invention.

Referring more specifically to FIG. 1 the individual parts or members 9 of the cooling fin jacket in each case consist of two concentric cylindrical wall sections 1 and 2 which are joined together by heat conducting bars 3. Through this structure there are formed longitudinal chamber 8, as in FIG. 1, or circumferential chamber 18 as in FIG. 2 having high stability, which take up the shielding of neutrons. The neutron shielding material can, e.g. consist of a work material having a high hydrogen content which is inserted, e.g. with synthetic resin as filler into the chambers 8. However, altogether all appropriate neutron moderating and absorbing materials are accommodated in the chambers 8.

Figure 2:
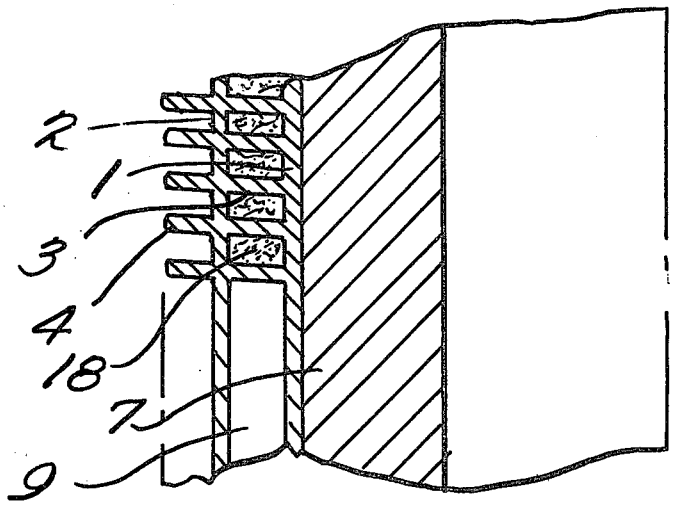
FIG. 2 is a longitudinal section of such a container.

The cooling fins 4 are placed on the outer cylindrical wall section 2 in FIG. 1 in the longitudinal direction or in FIG. 2 in the circumferential direction. The individual partial shells 9 are equipped with flanges 5 and fastened on the container with screws 6 on the container 7.

Figure 4:
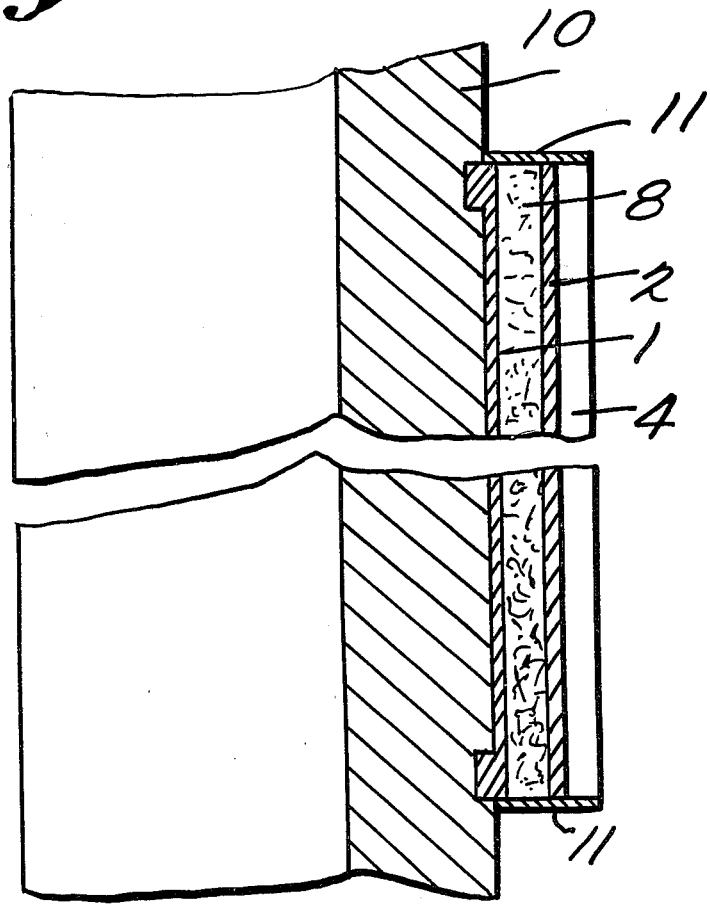
FIG. 4 illustrates the closing of the longitudinal chamber.

The axial fixing of the shell part 9 takes place through suitable holding element 10, as e.g. bolts or a tip stretched collar, which guarantees a shape determined solid connection with the container 7. An illustrative embodiment is shown in FIG. 4.

The inherent stability of the partial shell 9 permits the adjusting of its inner diameter shape exactly to the container outer diameter.

Figure 3:
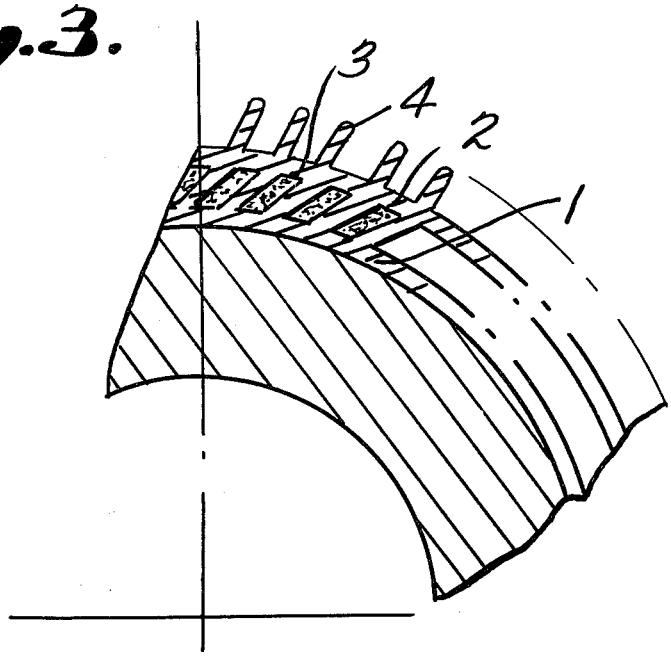
FIG. 3 illustrates a particularly preferred embodiment of the heat conducting bar.

A particularly advantageous embodiment of the heat conducting bar is shown in FIG. 3 through which the sloping arrangement of the heat conducting bar 3 takes place between the cylindrical wall sections 1 and 2 and their partial covering, also a covering of the neutron shielding and through this there is prevented a direct passage of the neutron radiation through the heat conducting bars 3.

The longitudinal chamber 8, as is represented for example in FIG. IV is closed by sealing element 11, as, e.g., end plates.

Preferably the individual (or separate) parts 9 of the cooling fin jacket can be produced from metals and/or metal alloys, as uranium or suitable known alloys, which are particularly effective in shielding the gamma radiation. Through this very advantageously an especially compact container size is possible since in this manner the partial shell of the cooling fin jacket receives at least a part of the shielding function of the base container. Also in the case of cylindrical base containers with quadratic or rectangular fuel element-reception inner cross-section the additionally required shielding on account of the edge geometry can be taken care of through the cooling fins jacket partial shell. For this purpose the thickness of the cylindrical wall cross-section 1 of the cooling fin jacket can be adjusted in a decreasing manner.

The entire disclosure of German priority application G7911030.8 is hereby incorporated by reference.

What is claimed is:

1. A shielding container suitable for the transportation or storage of spent fuel elements from nuclear reactors, said shielding container having a cooling fin jacket, said jacket being formed of a plurality of joinable, individually removable parts comprising two concentrical, metallic cylindrical wall sections joined together by heat conducting bars, said cooling fin jacket being fitted to the container wall.

2. A shielding container according to claim 1 wherein the cooling fin jacket has at most four individual parts.

3. A shielding container according to claim 1 wherein the heat conducting bars and the cylindrical wall sections define channels, said channels being filled with a neutron absorbing material.

4. A shielding container according to claim 3 wherein the front side of the channels is closed by sealing means.

5. A shielding container according to claim 4 wherein said removable parts are fixed to the container by holding means and are secured in the axial direction by retaining means.

6. A shielding container according to claim 5 wherein the removable parts comprise a good gamma ray absorbing heavy metal.

7. A shielding container according to claim 6 wherein the removable parts are made of uranium or a uranium alloy.

8. A shielding container according to claim 6 wherein the removable parts are provided with cooling fins.

9. A shielding container according to claim 8 wherein the heat conducting bars are disposed slopingly between cylinder wall sections and are partially covered in the radial direction.

10. A shielding container according to claim 6 wherein the heat conducting bars are disposed slopingly between cylinder wall sections and are partially covered in the radial direction.

11. A shielding container according to claim 5 wherein the heat conducting bars are disposed slopingly between cylinder wall sections and are partially covered in the radial direction.

12. A shielding container according to claim 4 wherein the heat conducting bars are disposed slopingly between cylinder wall sections and are partially covered in the radial direction.

13. A shielding container according to claim 3 wherein the heat conducting bars are disposed slopingly between cylinder wall sections and are partially covered in the radial direction.

14. A shielding container according to claim 1 wherein the heat conducting bars are disposed slopingly between cylinder wall sections and are partially covered in the radial direction.

15. A shielding container according to claim 5 wherein the removable parts are provided with cooling fins.

16. A shielding container according to claim 4 wherein the removable parts are provided with cooling fins.

17. A shielding container according to claim 3 wherein the removable parts are provided with cooling fins.

18. A shielding container according to claim 1 wherein the removable parts are provided with cooling fins.

19. A shielding container according to claim 4 wherein the removable parts comprise a good gamma ray absorbing heavy metal.

20. A shielding container according to claim 3 wherein the removable parts comprise a good gamma ray absorbing heavy metal.

21. A shielding container according to claim 1 wherein the removable parts comprise a good gamma ray absorbing heavy metal.

22. A shielding container according to claim 3 wherein said removable parts are fixed to the container by holding means and are secured in the axial direction by retaining means.

23. A shielding container according to claim 1 wherein said removable parts are fixed to the container by holding means and are secured in the axial direction by retaining means.

24. A shielding container according to claim 1 wherein the front side of the channels is closed by sealing means.

* * * * *